United States Patent [19]

Rollins

[11] 4,275,017

[45] Jun. 23, 1981

[54] RING CONTROLLED VARIABLE VENTURI DOWNDRAFT CARBURETOR

[75] Inventor: Ralph T. Rollins, Salt Lake City, Utah

[73] Assignee: Clinton Graybill, Superior, Mont.

[21] Appl. No.: 88,952

[22] Filed: Oct. 29, 1979

Related U.S. Application Data

[63] Continuation of Ser. No. 907,985, May 22, 1978, abandoned.

[51] Int. Cl.[3] ..... F02M 7/24

[52] U.S. Cl. ..... 261/53; 261/DIG. 56; 261/121 B

[58] Field of Search ..... 261/53, DIG. 56, 121 B

[56] References Cited

U.S. PATENT DOCUMENTS

| | | | |
|---|---|---|---|
| 1,607,052 | 11/1926 | Brinkman | 261/53 |
| 1,803,150 | 4/1931 | Stokes | 261/121 B |
| 1,969,638 | 8/1934 | Culp | 261/DIG. 56 |
| 2,007,337 | 7/1935 | Mallory | 261/53 |
| 4,000,225 | 12/1976 | Heilig et al. | 261/DIG. 56 |
| 4,001,356 | 1/1977 | Graybill | 261/40 |
| 4,087,493 | 5/1978 | Petermann | 261/62 |
| 4,088,715 | 5/1978 | Graybill | 261/121 B |
| 4,118,444 | 10/1978 | Abbey | 261/DIG. 56 |
| 4,132,752 | 1/1979 | Petermann | 261/121 B |

FOREIGN PATENT DOCUMENTS

| | | | |
|---|---|---|---|
| 391256 | 3/1924 | Fed. Rep. of Germany | 261/53 |
| 123360 | 2/1919 | United Kingdom | 261/63 |

*Primary Examiner*—Tim R. Miles

*Attorney, Agent, or Firm*—Wells, St. John & Roberts

[57] ABSTRACT

A variable Venturi condition responsive carburetor wherein a control ring, movable in response to engine operating conditions regulates the amount of air that is mixed with incoming fuel as it passes through metering tubes to provide for total air fuel mixing prior to its being introduced into the combustion chambers of an internal combustion engine. The control ring also regulates the amount of fuel supplied through the metering stem, provides a means for providing automatic compensation for fuel mix changes necessary due to changes in atmospheric pressure such as will occur during altitude changes and regulates flow through a demand fuel circuit. An arrangement of fixed and movable Venturi elements is used to vary the fuel flow through the carburetor in response to the throttle linkage manipulation.

5 Claims, 4 Drawing Figures

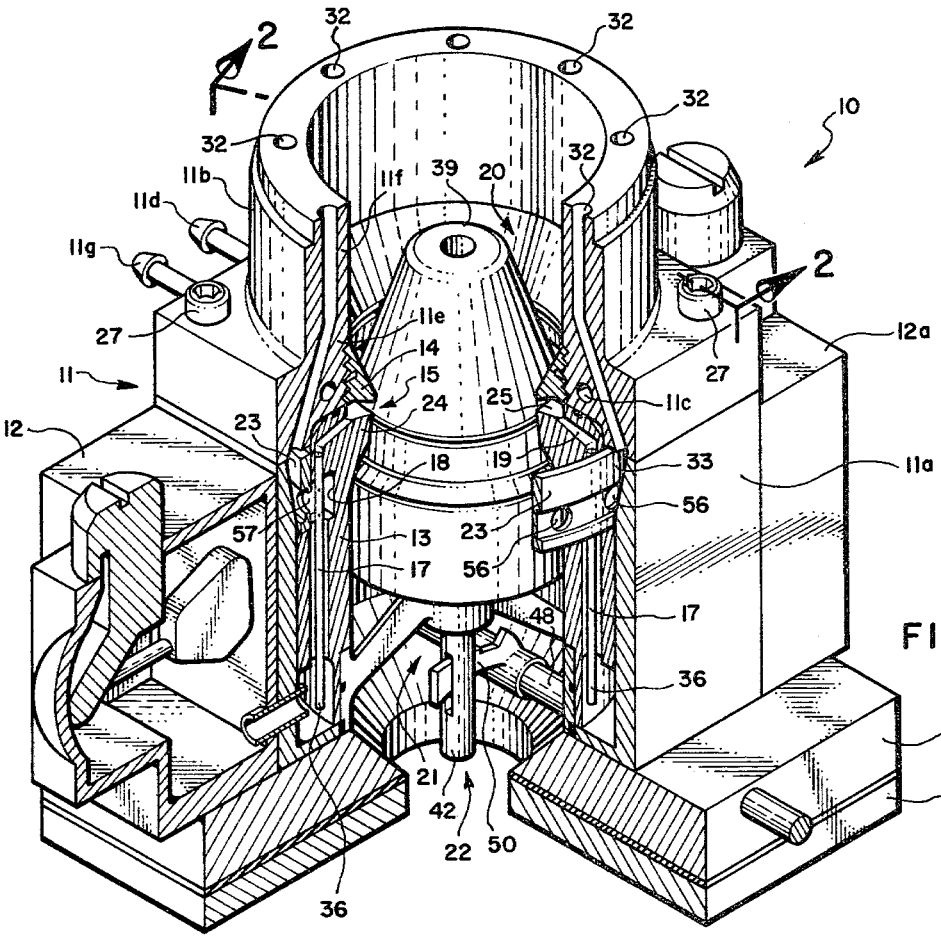
FIG. 1
FIG. 3
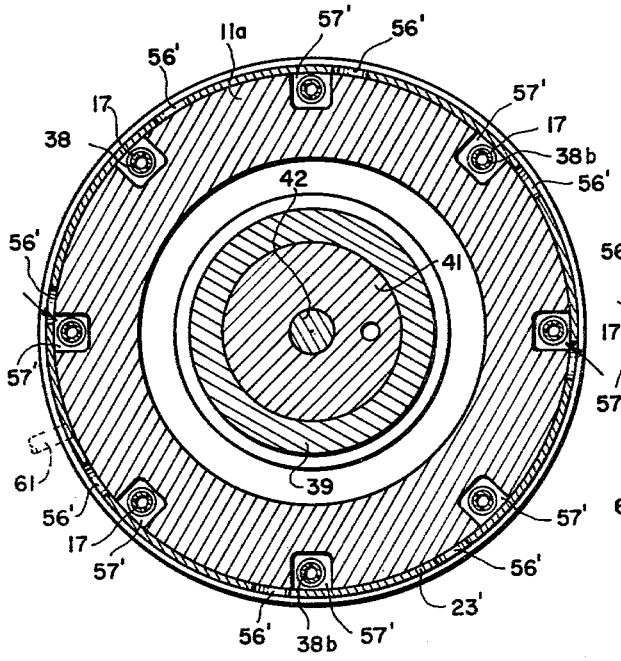
FIG. 4
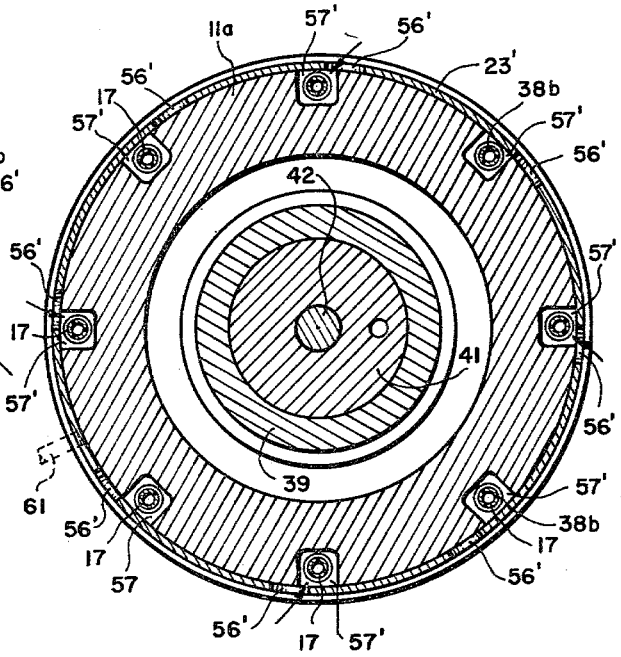

RING CONTROLLED VARIABLE VENTURI DOWNDRAFT CARBURETOR

This is a continuation, of application Ser. No. 907,985, filed May 22, 1978, now abandoned.

BRIEF DESCRIPTION OF THE INVENTION

1. Field of the Invention

This invention relates to carburetors for internal combustion engines, and more particularly, to such carburetors having a variable Venturi orifice as a means of regulating fuel flow to the internal combustion engine.

2. Prior Art

Variable Venturi carburetors have been known in the past. U.S. Pat. Nos. 3,940,460, 3,970,730, and 4,001,356, all issued to Clinton R. Graybill, for example, show carburetors having a fixed Venturi element and a movable Venturi element, with the volume and velocity of fuel flow being responsive to the position of the movable Venturi element. The variable Venturi carburetors known heretofore have proven more efficient and effective than fixed Venturi carburetors in operating under the wide range of conditions to which such carburetors are subjected when used with the internal combustion engines of vehicles, for example.

As well recognized in the prior art patents, most carburetors in preset use today, employ a fixed Venturi to create a vacuum pressure in the carburetor induction duct to pull fuel from the fuel reservoir. Such a fixed Venturi is efficient for only a small range of engine R.P.M. and consequently different sizes of Venturis must be used for engines of different sizes. So used, the Venturis are not entirely satisfactory, since the engines are operated under constantly changing conditions. As a result many modifications have been made to existing Venturi carburetors to make them acceptable for use in present day engines. Special idle jets, accelerator fuel pumps, multiple Venturi tubes and combinations of these have been used in conjunction with the fixed Venturi, but these have not been truly efficient and do not provide optimum fuel economy along with maximum engine performance.

Variable Venturi carburetors of the type disclosed in the above identified patents are intended to provide a carburetor that will effectively operate throughout the entire engine operation range, i.e., from idle to full throttle R.P.M. while maintaining a correct air-fuel mixture.

It has been found, however, that even with the variable Venturi, as the amount of fuel is varied in response to throttle operation a proper air-fuel mix, consistent with the operating conditions of the engine, is not always maintained. Consequently, means must be provided to vary the air intake in accordance with the operating conditions of the engine. It is for this reason, that in the past a number of fuel circuits have been provided in the carbuetors, with each circuit being separately operated and controlled.

It is a principal object of the present invention to provide means responsive to the operating conditions of the engine that will vary and regulate the air entrained and mixed with the incoming fuel such that a proper air-fuel mix will be constantly maintained throughout the entire engine operation.

Another object of the invention is to provide a variable Venturi carburetor wherein the air controlled in response to engine condition is mixed with fuel being supplied to the Venturi through metering stems and wherein the air is entrained as bubbles in the fuel in the metering stems, with the bubbles bursting to provide uniform mixing with the fuel as the fuel is entrained into incoming air passing through a movable Venturi.

Still another object of the invention is to provide a variable Venturi carburetor wherein air passing through the carburetor and the formed Venturi therein, will uniformly entrain air-fuel mix from the metering stems.

Yet another object of the present invention is to provide a variable Venturi downdraft carburetor including means to heat incoming air to insure proper combustion temperatures of the air-fuel mix provided by the carburetor and to prevent freezing up of the carburetor.

Principal features of the invention include a housing with a lower peripheral chamber adapted to contain fuel, such as gasoline, and an inner bowl, through which metering stems are passed to extend into fuel in the reservoir, and said inner bowl including an inturned lip, forming part of a central fixed Venturi member. An annular cavity ring is threaded into the housing to the extent desired to form an opening at the Venturi throat. The upper or discharge ends of the metering stems are then connected by passageways to the opening formed at the Venturi throat and, as will be further explained, fuel and air is drawn through the metering stems to be entrained at the Venturi throat with air moving therepast. Port means are provided in the body housing to interconnect with atmosphere ad an air chamber which surrounds an upper portion of the metering tubes. A control ring surrounds the metering tubes and regulates flow through the air chamber in accordance with the position of the control ring. The control ring also controls creation of a vacuum in the air chamber and movement of fuel thereinto to satisfy changing engine requirements. The position of the control ring is changed in response to engine temperature and vacuum pressure actuated means that are coupled to the control ring.

A movable Venturi element is arranged to cooperate with the annular cavity ring and inner bowl to provide a Venturi action between these members.

The movable Venturi member is operated by a throttle control linkage and is moved downwardly to increase the size of the Venturi throat and to thereby pull additional fuel through the metering stem for delivery to the engine. A support assembly is provided to support the movable Venturi member and spring means positioned between the support assembly and the movable Venturi member will normally insure movement of the movable Venturi member into a position where the smallest Venturi throat is created.

An encircling passage at the air inlet to the carburetor receives heated engine liquids to heat air entering the carburetor to an optimum temperature for air-fuel combustion and to prevent freezing up of the carburetor due to the velocity of the incoming air.

Other objects and features of the invention become apparent from the following detailed description, taken together with the accompanying drawings, showing a preferred embodiment of the invention.

THE DRAWINGS

In the drawings:

FIG. 1 is a cut-away pictorial view of the carburetor of the invention;

FIG. 2, a vertical section view through the carburetor, taken on the line 2—2 of FIG. 1;

FIG. 3, a section corresponding to that taken on the line 3—3 of FIG. 1, but showing a modified version of the carburetor with the outer portion of the housing removed for clarity; and FIG. 4, a view like that of FIG. 3, but with the control ring repositioned.

DETAILED DESCRIPTION

Figure 2:
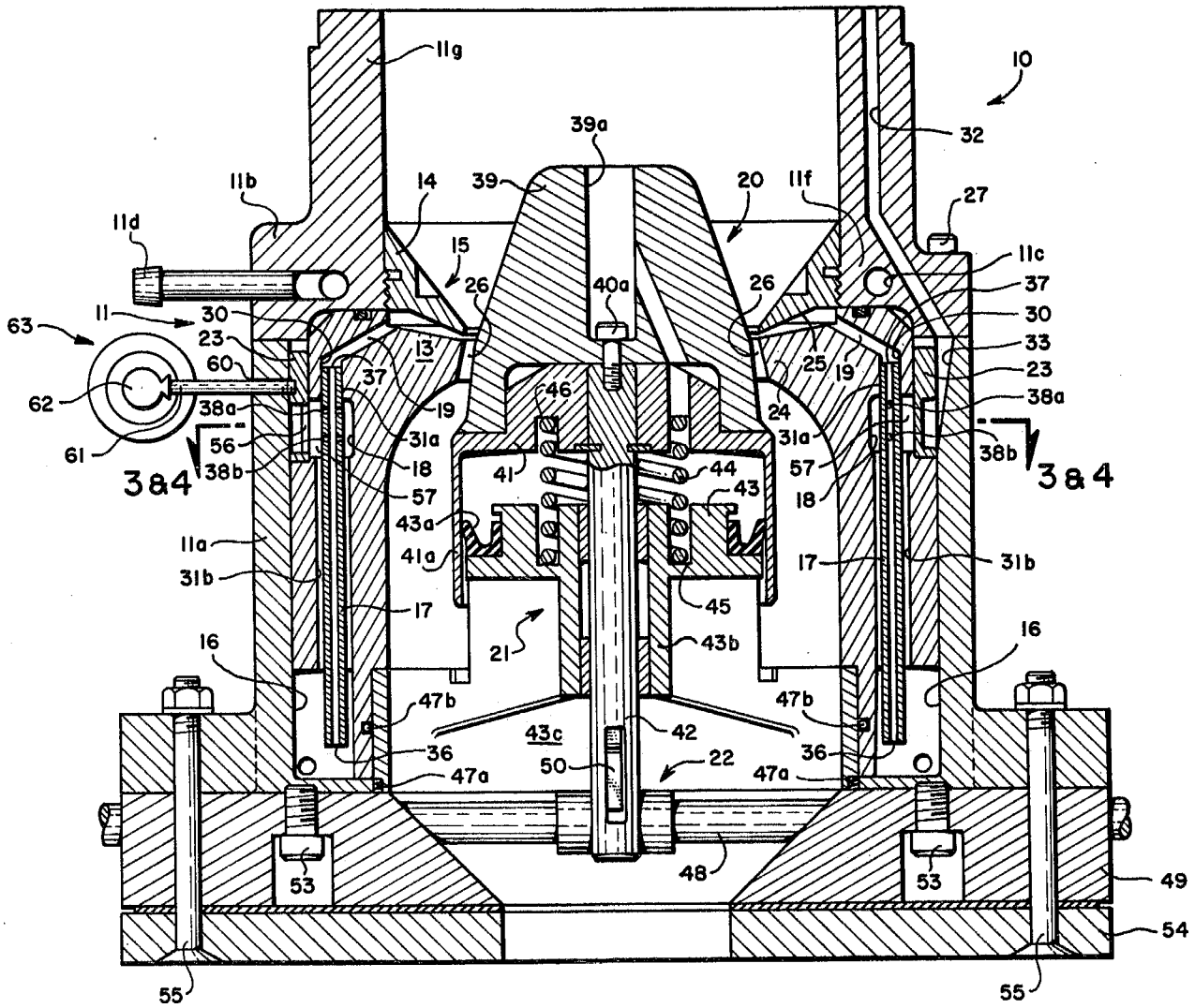

Referring now to the drawings:

In the illustrated preferred embodiment, the carburetor of the invention, shown generally at 10, includes a housing 11 with fuel storage reservoirs 12 and 12*a* at opposite sides of the housing 11, and a inner bowl 13 inside the housing 11, said inner bowl 13 cooperating with an annular cavity ring 14 to form a fixed Venturi member, shown generally at 15.

A fuel chamber 16 is formed at the lower periphery of the housing 11 and the fuel chamber receives liquid fuel from the conventional level maintaining reservoirs 12 and 12*a*. Metering stems 17 are spaced around the inner bowl and each extend upwardly from the fuel chamber 16 through an air chamber 18 to a passage 19 connected into the throat of the Venturi. A movable Venturi member, shown generally at 20, is adapted to be reciprocated vertically with respect to a support assembly shown generally at 21. The movable Venturi member is connected to a throttle control linkage shown generally at 22, and the throttle control linkage is adapted to be operated in the usual fashion, such as by the usual accelerator pedal of a vehicle. A control ring 23 surrounds the air chamber 18 of the inner bowl and provides a means by which air is supplied to the metering stem to be entrained with fuel passing therethrough.

As shown, housing 11 actually comprises two component parts. The lower housing assembly 11*a* is of generally cylindrical configuration and the upper housing portion 11*b* is adapted to fit on the top of the lower housing portion 11*a* and to be bolted securely thereto. The upper housing portion 11*b* has an encircling passage 11*c* within the upper rim of the housing. The encircling passage has an inlet 11*d* and an outlet 11*e*. Hot engine water or oil is circulated in inlet 11*d* passed through the encircling passage 11*c* and out outlet 11*e* back to the cooling or lubricating system of the vehicle. As will be apparent hereafter, air entering the carburetor is pulled down through the housing containing the encircling passage 11*c* where it will be warmed to an optimum temperature such that the resulting air-fuel mix will most effeciently combust in the engine. The upper housing includes a ring-shaped section 11*e* that is adapted to be secured to the lower housing portion 11*a* and an upwardly extending wall 11*f* that is inwardly offset with respect to the portion 11*e*. An inwardly projecting lip 24 of the inner bowl 13 fits beneath the offset portion interconnecting ring portion 11*e* and beneath wall 11*f* and cooperates with the annular cavity ring 14 that is threaded into the lower portion of wall 11*f* to form an intake opening 25 communicating with a Venturi throat 26 as will be hereinafter further described. Bolts 27, spaced around the upper housing member inner connect the ring portion 11*e* with the lower housing assembly. The size of the intake opening 25 is regulated by the positioning of the annular cavity ring 14 within the wall 11*f*.

The bores 19 are spaced around the inner bowl and extend from the inlet opening 25 angularly to connect with bores 30 that extend upwardly through the inner bowl. Each bore 30 has a metering stem 17 therein, with the metering stem extending downwardly through the inner bowl and into the fuel reservoir 16. The upper end of each metering stem 17 fits tightly in a bore 31*a* and opens at its top end to a bore 19. Each metering stem 31 then passes downwardly through an air chamber 18 and a bore 31*b* that has a greater diameter than the outside diameter of the metering stem. The bores 31*b* open at their lower ends to the fuel chamber 16 and thus interconnect the fuel chamber 16 and the air chamber 18.

Atmospheric air is supplied to the control ring 23, which as will be hereinafter explained regulates air flow to the air chamber 18 through aligned ports 32 in the upper housing assembly and 33 in the lower housing assembly. The metering tubes 17 are each hollow and extend downwardly through ports 31*b* into the fuel chamber 16. The metering tubes each have an opening 36 at its lower end, through which fuel from the fuel reservoir 16 is picked up in the tube. The tops of the tubes have a port 37 therethrough and additional ports 38*a* and 38*b* are provided through the wall of the metering stem as it passes through the air chamber 18. The ports 38*a*, through the wall of each metering stem are preferably spaced 120° apart around the stem and just below the top of the air chamber 18. The ports 38*b* similarly extend through the wall of the metering stem and are preferably spaced 120° apart around the stem, but these parts are located just above the bottom of air chamber 18, all as will be further explained.

The Venturi throat 26 is formed by the innermost end of the annular cavity ring 14, the inner lip 23 of the inner bowl and an air calibration cone 39 that forms part of the movable Venturi member 20. A bolt 40*a* is positioned in a bore 39*a* of cone 39 and extends through the cone to secure the cone and to thereby clamp a cup member 41 to an actuator stem 42. The wall 41*a* of the cup member 41 projects downwardly around a spring support 43 of the support member 21. A seal 43*a* positioned in a recess formed around the periphery of the spring support ring 43 engages the inner surface of the cup wall 41*a* provide a sealing engagement between the members. A spring 44 has one end positioned in a ring-shaped groove 45 formed in the spring support ring 43 and its other end seated in a similar ring-shaped groove 46 of the cup member 41. The spring 44 thus acts to move the cup member 41 and cone 39 upwardly when a downward force is not being applied thereto through the throttle linkage, shown generally at 22.

The spring support ring 43 includes a tubular portion 43*a* that projects downwardly around the stem 42 and a base 43*b* that fits tightly within inner bowl 13. O-rings 47*a* and 47*b* prevent leakage of fuel from fuel chamber 16 between the inner bowl 13 and the support member 43.

The throttle linkage 22 includes a shaft 48 journaled through an insulator plate 49 positioned beneath the lower housing assembly 11 and a link 50 secured to shaft 48, rotatable therewith and hooked into the lower end of the stem 40 such that rotation of the shaft 48 by conventional throttle connecting linkage, not shown, will raise and lower the stem 42.

Bolts 53 secure the insulator plate 49 to the lower housing assembly and an adapter plate 54 is arranged to be secured by bolts 55 to the insulator plate. The adaptor plate 54 allows the carburetor to be fitted to engines originally adapted to receive other conventional type carburetors.

The control ring 23 has ports 56 spaced therearound. The ports 56 are adapted to align with ports 57 through the outer wall 58 of air chamber 18 and to rotate out of alignment therewith. The ring 23 fits tightly around the wall 58, so that as the ring rotates it acts as a gate valve, allowing a maximum amount of air from the ports 32 and 33 through to the metering stems 17 when the ports 56 and 57 are aligned, stopping such flow when the ports are totally out of alignment and restricting the air flow when the ports are only partially aligned.

The control ring also functions to control the amount of fuel fed from the fuel chamber 16 to the Venturi to be mixed with the rush of air coming into the carburetor. When the ring is positioned such that the ports 56 and 57 are fully aligned the air passing therethrough will be pulled into the ports 38*a* and 38*b* and a positive pressure will be maintained in air chambers 18. As the control ring is rotated to move ports 56 out of alignment with ports 57 the pressure in air chamber 18 changes, since the negative pressure created at the Venturi will be transmitted through the metering stems 31 and the ports 38*a* and 38*b*. As the pressures in air chambers 18 become negative the fuel in chamber 16 is pulled thereinto through bores 31*b* and then through ports 38*b* into the metering stem. This fuel entering the metering stem through ports 38*b* is then mixed with the air entering the metering tubes through ports 38*a* before being pulled through opening 25 and into the Venturi throat 26.

When the ports 56 are out of alignment with ports 57, very little, if any atmospheric air can enter air chamber 18 and the negative pressure developed therein will allow the fuel from fuel chamber 16 to fully fill the air chamber 18 and to be drawn into the metering stem through both sets of ports 38*b* and 38*a*. The fuel supplied to the Venturi throat 26 when the ports 57 are closed is not mixed with air and, when mixed with the rush of air down through the Venturi provides a rich fuel air mix.

As viewed in FIGS. 3 and 4, the control ring, here shown as 23' may also be arranged so that as the position of the control ring is changed the number of openings 56' therein aligned with ports 57' opening through the housing 11*a* to the air chamber containing a metering stem will be varied. With this arrangement of control ports an additional control is provided to regulate fuel flow, as well as the air-fuel mix through the carburetor. As illustrated in FIG. 3, two sets of ports 56' and 57' are partially aligned while in FIG. 4, the control ring position has been changed and four sets of ports 56' and 57' are aligned or partially aligned.

It has been found that increased efficiency is obtained if the ports 38*a* and 38*b* are equally spaced 120° around the metering stem, as heretofore described, since the air pulled therethrough into the stems effectively forms bubbles that move with the fuel to the opening 25. The bubbles stretch out around the lip 23 as they approach the opening 25 because of the differences in pressure developed in the areas between the ports 29 and, when the opening 25 is properly sized, the stretched out bubbles will burst just before reaching the mouth of opening 25. This bubble bursting action causes a complete dispersion of the fuel into the downward rush of air and allows for more effective combustion of the fuel-air mix supplied by the carburetor to an engine.

For maximum efficiency the bubbles create by air entering the metering stems 31 should have a diameter of between 0.050 inch and 0.070 inch and preferably are about 0.060 inch in diameter. With gasoline fuel the film surrounding an air bubble is most uniform in thickness when the bubble is about 0.060 inch in diameter. Experiments have shown that if the bubble formed has a diameter smaller than 0.050 inch or larger than 0.070 inch it does not stretch uniformly before bursting and some of the efficiency of the carburetor is lost.

The ports 56 and 57 serve the additional function of automatically varying the amount of air entering the air chamber 18 in accordance with changes in the atmospheric pressure resulting from altitude changes. Thus, less of the denser air at sea level will pass through the ports in any given alignment condition of the ports than will less dense air at higher altitudes.

A slot 60 through the wall of the lower housing assembly 11*a* allows a post 61, one end of which is threaded into control ring 23, to project therethrough. The post 23 is then connected to the plunger 62 of a conventional temperature and vacuum pressure responsive diaphragm assembly 63 to be rotated in response to movement of the plunger.

In operation, the spring 44 will normally bias the cone 38, the cup member 39 and stem 40 upwardly to the position shown in FIG. 2.

In starting the internal combustion engine with which the carburetor of the invention is used, the accelerator pedal is depressed to operate through linkage 22 and to lower the cone 39, cup member 41 and stem 42, and the engine ignition system is actuated. As the engine starts, the rush of air down through the housing 11 and through the Venturi 26 creates a low pressure that draws fuel into the Venturi throat from chamber 16, through the metering stems 18 and the ports 25. With the engine cold, the diaphragm assembly 63 is spring biased to position control ring 23 such that the ports 56 and 57 are out of alignment. Thus, no additional air is drawn into the fuel passing through the air chamber 18 and metering stems 17 and essentially unmixed fuel is drawn into the Venturi throat to then be mixed with the air rushing down through the carburetor. When the engine heats up to a predetermined temperature the diaphragm assembly rotates the control ring 23 to permit air flow through ports 56 and 57 and into the metering stems 17. The incoming air is thus thoroughly mixed with the fuel passing through the metering stems to provide a leaner fuel mix to be mixed with the air passing down through the carburetor housing. The amount of air entrained in the fuel in the metering stems is thus governed by the position of the control ring and the alignment of ports 56 and 57, as determined by the vacuum acting on diaphragm assembly 63.

During the idling condition of the engine, after the engine is warm the engine vacuum will operate to position ring 23 such that air will be entrained in the fuel passing through the metering stems 17 in an amount determined by the vacuum of the engine. This same condition will also result during normal running operations of the engine. If, however, the accelerator pedal is depressed to rapidly increase the running speed of the engine the resultant engine vacuum will act through diaphragm assembly 63 to greatly reduce or cut off air flow through ports 56 and 57 thereby resulting in flow of fuel through the bottoms of the metering stems, and also through the ports 38*a* and 38*b*, as previously described.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A variable venturi carburetor, comprising:

a carburetor housing having a central passage extending therethrough;

a fixed venturi member having an annular surface fixed in the central passage;

a movable venturi member having an annular surface cooperating with the annular surface of the fixed venturi to form a venturi throat therebetween;

means for moving the movable venturi member with respect to the fixed venturi member to vary the size of the venturi throat;

a fuel chamber;

a plurality passage means interconnecting the fuel chamber and the venturi throat at angularly spaced locations through the fixed venturi member for delivering fuel to the venturi throat;

atmospheric air bleed means for bleeding atmospheric air into the passage means to vary the fuel-air mixture passing through the passage means to the venturi throat;

said atmospheric air bleed means including:

bleed ports associated with respective passage means for bleeding atmospheric air through the ports into the passage means;

an annular bleed control ring movably mounted on the fixed venturi member in juxta position to the bleed ports for angular movement with respect to the bleed ports;

said annular bleed control ring having apertures formed therein for registering with respective bleed ports; and drive means responsive to engine vacuum and operatively connected to the annular control ring for moving the annular bleed control ring angularly to move the ring apertures into and out of registry with the bleed ports to vary the amount of atmospheric air passing into the passage means to vary the fuel air mixture passing through the passage means to the venturi throat.

2. The variable venturi carburetor as defined in claim 1 wherein the bleed ports and the control ring apertures are angularly offset such that upon rotation of the control ring variable numbers of apertures come into and out of registry with the bleed ports.

3. The variable venturi carburetor as defined in claim 1 wherein the passage means includes a plurality of hollow metering stems each having a lower end extending into the fuel chamber and air chambers extending about upper ends of the stems and wherein the bleed ports open into the air chambers to bleed atmospheric air into the air chambers.

4. The variable venturi carburetor as defined in claim 3 wherein the upper ends of the stems have operative ports formed therein to permit air to pass into the stems to premix air with the fuel prior to entering the venturi throat.

5. The variable venturi carburetor as defined in claim 3 further comprising a bore surrounding each of the metering stems and extending downward into the fuel chamber.

* * * * *